US008500616B2

(12) United States Patent
Barnes et al.

(10) Patent No.: US 8,500,616 B2
(45) Date of Patent: Aug. 6, 2013

(54) TONER MASS CONTROL BY SURFACE ROUGHNESS AND VOIDS

(75) Inventors: Johnathan Lee Barnes, Richmond, KY (US); Jeannette Quinn Bracken, Paris, KY (US); Sudha Chopra, Lexington, KY (US); Jeremy Lavern Daum, Lexington, KY (US); Gerald Lee Fish, Lexington, KY (US); Bhaskar Gopalanarayanan, Lexington, KY (US); Leea Danielle Haarz, Lexington, KY (US); Ronald Lloyd Roe, Lexington, KY (US); Matthew Joe Russell, Stamping Ground, KY (US); James Joseph Semler, Lexington, KY (US); Todd Joseph Svoboda, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 1218 days.

(21) Appl. No.: 11/869,184

(22) Filed: Oct. 9, 2007

(65) Prior Publication Data

US 2009/0092420 A1 Apr. 9, 2009

(51) Int. Cl.
*G03G 15/08* (2006.01)

(52) U.S. Cl.
USPC ..... 492/37; 492/28; 492/30

(58) Field of Classification Search
USPC ..... 29/895.3, 895.33, 895.32; 492/37, 492/28, 30
See application file for complete search history.

(56) References Cited

U.S. PATENT DOCUMENTS

| | | | | |
|---|---|---|---|---|
| 3,731,146 | A | 5/1973 | Bettiga et al. | |
| 4,656,964 | A | 4/1987 | Kanno et al. | |
| 4,930,438 | A * | 6/1990 | Demizu et al. | 399/281 |
| 5,093,180 | A * | 3/1992 | Morgan | 428/156 |
| 5,599,266 | A * | 2/1997 | Landl et al. | 492/56 |
| 5,794,109 | A * | 8/1998 | Ota et al. | 399/286 |
| 6,072,975 | A | 6/2000 | Kyung | |
| 6,196,958 | B1 | 3/2001 | Shiraki et al. | |
| 6,226,483 | B1 | 5/2001 | Kazakos et al. | |
| 6,341,420 | B1 * | 1/2002 | Swartz et al. | 29/895.32 |
| 6,711,371 | B2 | 3/2004 | Koyama et al. | |
| 8,038,591 | B2 | 10/2011 | Barnes et al. | |
| 2005/0065006 | A1 * | 3/2005 | Tsubota et al. | 492/37 |

(Continued)

FOREIGN PATENT DOCUMENTS

EP 0789285 A2 8/1997

OTHER PUBLICATIONS

International Search Report and Written Opinion of the International Searching Authority dated Jul. 8, 2008 for PCT Application No. PCT/US/2008/079314 which claims priority to the present application.

*Primary Examiner* — David Bryant
*Assistant Examiner* — Christopher Besler

(57) ABSTRACT

The present disclosure relates to controlling a performance characteristic of an image forming device component having a surface which may include removal of a portion of the surface to expose a plurality of voids and a surface between the voids. The surface between the voids may have a surface roughness Ra in the range of 0.1 to 5.0 microns and the relationship $SA_V/(SA_V+SA_C)$ is equal to 1-50%, where $SA_V$ is the surface area of the voids and $SA_C$ is the remaining surface area of the component. The performance characteristic may include the control of toner mass conveyed and/or toner filming and/or the amount of residual toner removed from a photoconductive surface.

8 Claims, 7 Drawing Sheets

U.S. PATENT DOCUMENTS

2005/0202945 A1* 9/2005 Leung ..... 492/37
2006/0233571 A1 10/2006 Askren et al.
2006/0275049 A1 12/2006 Bethel et al.
2008/0240810 A1 10/2008 Barnes et al.

* cited by examiner

TONER MASS CONTROL BY SURFACE ROUGHNESS AND VOIDS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to the variation of surface roughness and/or voids on a component in an image forming apparatus. Such variation may be used to control a performance characteristic of the apparatus, such as toner mass conveyed and/or toner filming and/or the amount of residual toner removed from a photoconductive surface.

2. Description of the Related Art

Many image forming devices, such as printers, copiers, fax machines or multi-functional machines, utilize toner to form images on media or paper. The image forming apparatus may transfer the toner from a reservoir to the media via a developer system utilizing differential charges generated between the toner particles and the various components in the developer system. In particular, one or more toner adder rolls maybe included in the developer system, which may transfer the toner from the reservoir to a developer roller. The developer roller may then apply the toner to a selectively charged photoconductive substrate forming an image thereon, which may then be transferred to the media.

SUMMARY OF THE INVENTION

In a first exemplary embodiment, the present disclosure relates to a method for controlling a performance characteristic of an image forming device component having a surface including removal of a portion of the surface to expose a plurality of voids and a surface between the voids. The surface between the voids is configured to have a surface roughness Ra in the range of 0.1 to 5.0 microns and wherein $SA_V/(SA_V+SA_C)$ is equal to 1-50%, where $SA_V$ is the surface area of the voids and $SA_C$ is the remaining surface area of the component. The performance characteristic may include the control of toner mass conveyed, toner filming and/or the amount of residual toner removed from a photoconductive surface.

In another exemplary embodiment, the present disclosure is directed at a method to assist in the manufacture of an image forming device component. The method may include generating for one or a plurality of image forming device components wherein the components have a plurality of voids and a surface roughness Ra between voids, a plot of surface roughness Ra between voids versus the percent of surface area containing voids for the plurality of image forming device components along with a calculation of relatively constant M/A lines (mass per unit area of toner conveyed by the image forming device component). The calculation may proceed via a regression analysis. One may then identify an operating space defined by an area between selected constant M/A lines followed by the manufacture of subsequent image forming device components with a surface roughness Ra between the voids and a percent surface area that is within the identified operating space.

In a still further exemplary embodiment, the present disclosure relates to a method for controlling a performance characteristic of a roller having a surface for an image forming device. The method includes removing a portion of the roller surface and exposing a plurality of voids and a surface between said voids. The surface between the voids may have a surface roughness Ra in the range of 0.1 to 1.5 microns wherein $SA_V/(SA_V+SA_R)$ is equal to 1-30%, where $SA_V$ is the surface area of the voids and $SA_R$ is the remaining surface area of the roller. The performance characteristic may include the control of toner mass conveyed, toner filming and/or the amount of residual toner removed from a photoconductive surface.

In yet a still further exemplary embodiment, the present disclosure is directed at an image forming device component having a surface comprising a plurality of voids and a surface between the voids. The surface between the voids may have a surface roughness Ra in the range of 0.1 to 5.0 microns and the relationship $SA_V/(SA_V+SA_C)$ is equal to 1-50%, where $SA_V$ is the surface area of the voids and $SA_C$ is the remaining surface area of the component. The surface roughness and the quantity $SA_V/(SA_V+SA_C)$ may both be configured to control a performance characteristic of the image forming device component.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
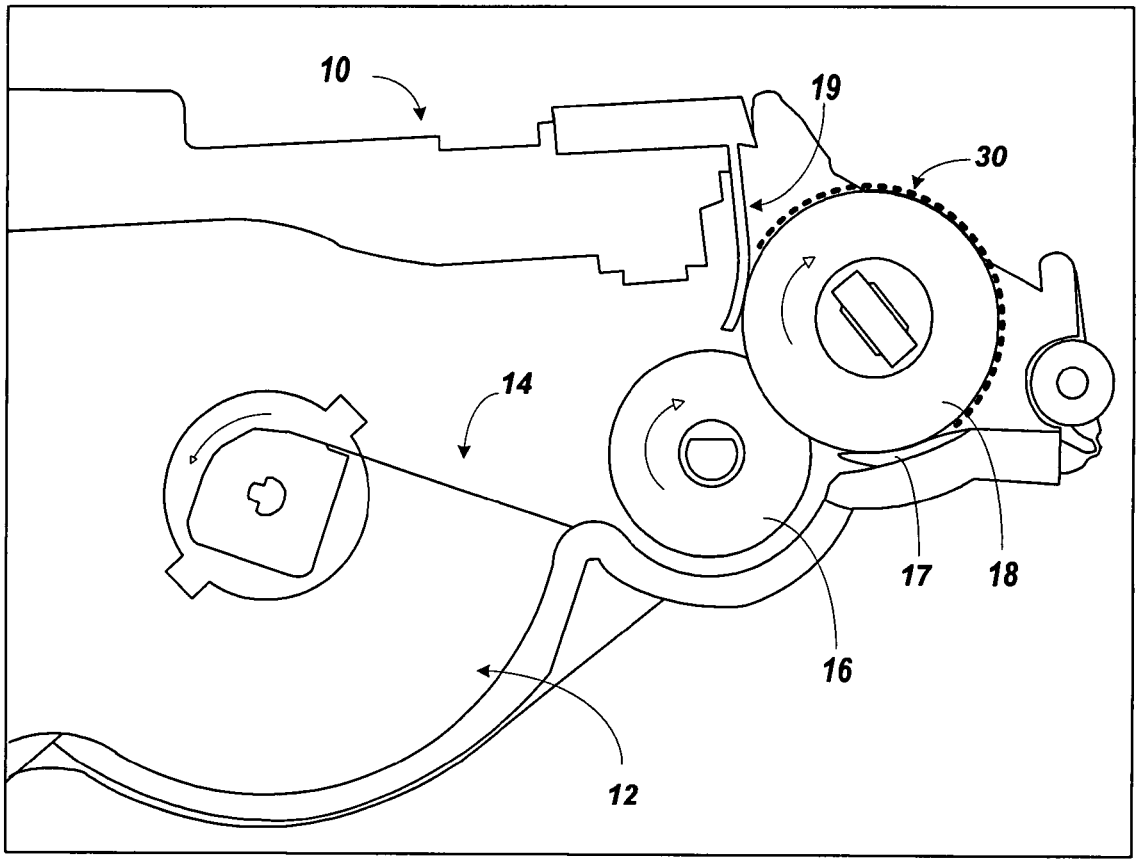
FIG. 1 is a cross-sectional view of an exemplary developer system in an image forming apparatus including a developer roller and/or toner adder roller.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure relates to controlling a performance characteristic of an image forming device component. The performance characteristic may be understood to include the control of toner mass conveyed and/or toner filming and/or the amount of residual toner removed from a photoconductive surface. The toner mass conveyed may be understood as the toner mass per unit area (M/A) on an image forming apparatus component which may be used in an electrophotographic printer or printer cartridge. In addition, the present disclosure relates to the actual image forming apparatus components that are formed by the indicated procedures having the indicated characteristics.

With attention to FIG. 1, a cross-section is provided of an exemplary printer cartridge 10. The cartridge may include a region 12 for toner and a paddle 14 to assist in conveying toner in the direction of a toner adder roller (TAR) 16 which in turn may be in contact with developer roller 18. A seal may also be provided at 17 as between the developer roller 18 and cartridge housing. As those skilled in the art will appreciate, the developer roller 18 may then be in contact with a photoconductive component, such as a photoconductive PC drum (not shown) such that toner may ultimately be conveyed from region 12 (which may sometimes be referred to as a toner sump) to the PC drum during the printing operation. A doctor blade 19 may also be in contact with the developer roll to assist in regulating toner layer thickness and toner charge on the developer roll. It should therefore now be appreciated that a contact region or "nip" may be present between the: (a) TAR 16 and developer roller 18; (b) developer roller 18 and PC drum; (c) developer roller 18 and seal 17; and (d) doctor blade 19 and developer roller 18.

In addition, and by way of example, a developer roller and PC drum herein may define a contact or nip region of nominally 1.0 mm and range from 0.5-1.5 mm, including all values and increments therein. Such nip region may then extend substantially along the length of the developer roller, which may be about 22-25 cm for a letter or A4 print width. The total force between developer roll and PC drum may be nominally 4 N and range from 2 to 7.5 N, including all values and increments therein. The pressure at the nip may then be nominally 175 g/cm$^2$ and range from 60-650 g/cm$^2$, including all values and increments therein. In the case of the contact region or nip that may be formed between a doctor blade and developer roller, such may provide a pressure of nominally 580 g/cm$^2$ and range from 230 g/cm$^2$ up to about 1215 g/cm$^2$, including all values and increments therein. It may also be appreciated that the nip location between the developer roller and toner adder roller (which may be in an opposing rotational configuration) may provide a pressure of about 20 g/cm$^2$ to about 90 g/cm$^2$, including all values and increments therein. It is therefore contemplated herein that the pressure in a contact region herein may be from about 20 g/cm$^2$ to about 1500 g/cm$^2$, including all values and increments therein.

Figure 2:
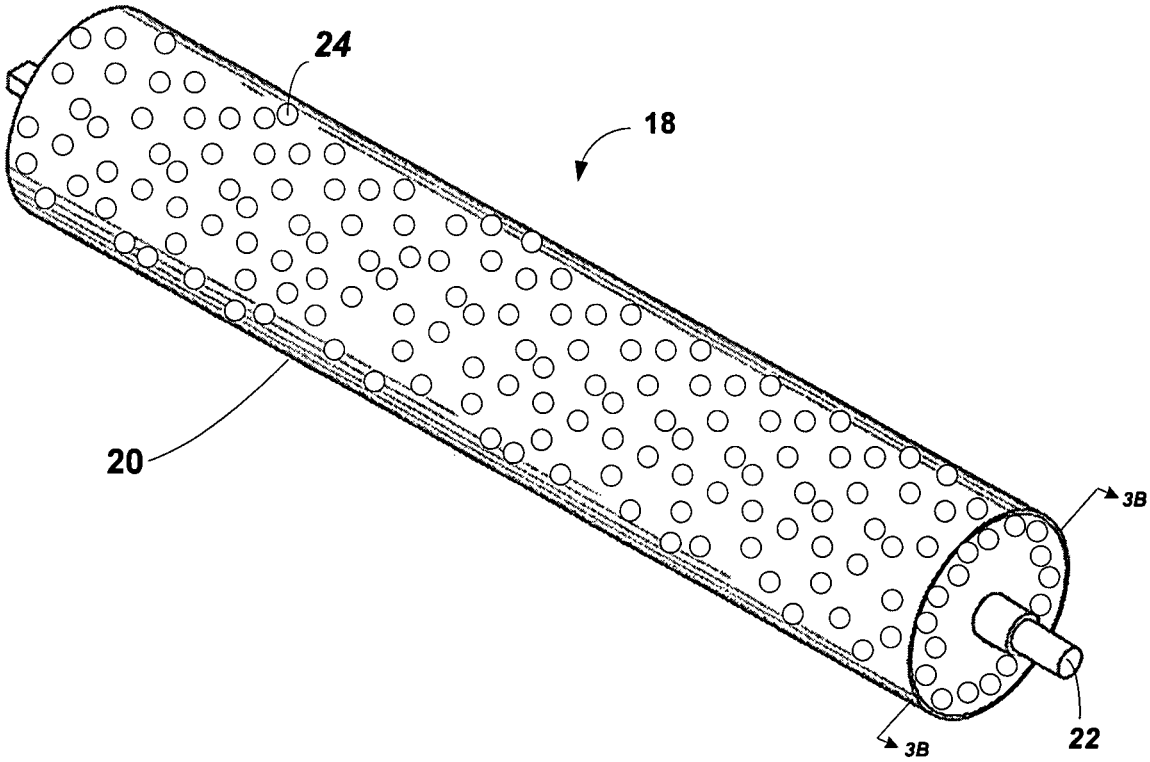
FIG. 2 is a perspective view of an exemplary developer roller including particulate embedded in the surface and near surface of the roller.

FIG. 2 illustrates an exemplary developer roller 18 which may include roller portion 20 and a shaft 22. The shaft may include materials that are either conductive or non-conductive. Conductive material would include metal such as aluminum, aluminum alloys, stainless steel, iron, nickel, copper, etc. Polymeric materials for the shaft may also include polyamide, polyetherimide, etc. The roller portion 20 may be made of a thermoplastic or thermoset elastomeric type material and may be a solid or foam material (thereby containing voids). Such voids may therefore be introduced during formation of the roller by a foam concentrate or blowing agent. The voids may also be introduced due the presence of dissolved gases. For example, in that situation where a thermoset elastomeric material is cured and exotherms while undergoing crosslinking, the dissolved gases may volatize and form void domains (e.g. cells) in the cured material.

It should be noted, however, that the present disclosure is not limited to those image forming apparatus that may rely upon a contact or nip region as described above. For example, it is contemplated herein that the current disclosure is applicable to what may be described as "jump-gap" technology, where there may be a finite gap between, e.g., the developer roller and PC drum where toner may be induced to move to the PC drum by electrostatics.

The roller herein may also include a surface coating that may be applied to the outer surface of the roller 18. Such surface coating may therefore be a resistive type coating. By elastomeric it should also be understood that the material may have a glass transition temperature (Tg) at or below room temperature (about 25° C.), as measured by a differential scanning calorimeter at a heating rate of about 5° C./min, which may be primarily (>50%) amorphous, or in application in, e.g., a printer, the material may substantially recover (>75%) after an applied stress (e.g. a compression type force). Accordingly, in the situation where a nip or contact may be required, the elastomeric material that may be employed for the roller 18 may be any material which provides the ability to elastically deform at a given nip location in the printer while also providing some level of nip pressure (i.e. pressure in the contact region).

The roller 18 may therefore be made by casting a urethane prepolymer mixed with diol (dihydroxy compound) such as a polydiene diol. The urethane prepolymer may include a polcaprolactone ester in combination with an aromatic isocyanate, such as toluene-diisocyanate. The roller may also contain a filler such as ferric chloride and the polydiene diol may include a polyisoprene diol or polybutadiene diol. The urethane developer roller may therefore be prepared by casting such urethane prepolymer mixed with the polydiene diol, along with a curing agent and filler such as ferric chloride powder, in addition to an antioxidant (e.g. a hindered phenol such as 2,2'-methylenebis(4-methyl-6-tertiarybutyl) phenol or 2,6 di-tertiary-4-methyl phenol). This may then provide a polyurethane containing polybutadiene segments. After curing, the roller may then be baked to oxidize the outer surface, which may then be electrically resistive. It is also contemplated herein that with respect to any such casting operation, particulate materials may be dispersed in such casting mixtures.

In an exemplary embodiment, the roller 18 may be prepared from Hydrin® epichlorohydrin elastomers, available from Zeon Chemicals Incorporated. In yet another exemplary embodiment, the roller 18 may be prepared from silicone, acrylonitrile-butadiene rubber (NBR) or other elastomers available in the market known commonly to those skilled in this field. The roller may then be coated and the coating cured by any of several methods known in the art. For example, the roller may be coated with a polyurethane type liquid coating, which may therefore include one type of polyurethane resin or a mixture of such resins, which is then cured. Such polyurethanes may also include moisture cured systems and may be sourced from ester-based polyurethanes formed from aromatic diisocyanates, such as TDI. The urethanes may also include polysiloxane type soft segments, such as a soft segment sourced from a hydroxy-terminated poly(dimthylsiloxane) or PDMS. One exemplary polyurethane coating therefore includes Lord Chemical CHEMGLAZE V022; Chemtura's VIBRATHANE 6060; and Chisso Corporation's Silaplane FMDA21 at a 50-50/5 ratio.

Expanding upon the above, the coating layer on the roller may exhibit an electrical volume resistivity in the range of about $1\times10^{8}$ ohm-cm to about $1\times10^{13}$ ohm-cm, over a variety of environmental conditions, including all values and increments therein. For example, the electrical volume resistivity may be in the range of about $1\times10^{10}$ ohm-cm to $1\times10^{12}$ ohm-cm at 15.5° C. and 20% relative humidity (RH) or $1\times10^{8}$ ohm-cm to $1\times10^{10}$ ohm-cm at 15.5° C. and 20% RH. In addition, the roller may exhibit a Shore A hardness in the range of 20 to 80, including all values and increments therein, such as 30 to 50, 40, etc.

Any particulate material may therefore be specifically combined with the liquid coating precursor prior to coating of a given roller, wherein the particulate may then be selectively removed by a finishing operation (see below) to provide a plurality of voids. The particulate material may therefore be combined with the coating precursors at a loading of between about 1-40% by weight, including all values and increments therein. The particulate may therefore include particulate that is capable of providing a triboelectric charge as disclosed in U.S. patent application Ser. No. 11/691,659, entitled "Image Forming Apparatus With Triboelectric Properties", filed Mar. 27, 2007, and assigned to the assignee of this disclosure, whose teachings are incorporated herein by reference. Triboelectric charging may therefore result in toner gaining electrons and becoming more negatively charged and/or toner losing electrons and therefore becoming more positively charged. The particulate may also include inorganic particulate, such as silica, alumina or polyhedral oligomeric silsesquioxanes or polyhedral oligomeric silicates, which may be characterized by the hybrid formula $(RSiO_{1.5})_n$ wherein R may be any functional group (e.g. a hydrocarbon group) and n is an integer.

The particulate may therefore be in the size range of about 0.1-50 μm, including all values and increments therein. For example, the particulate herein may be present in particulate form at a size range between about 1-40 μm, 1-30 μm, etc. In one exemplary embodiment the size range may therefore be in the range of about 10-20 μm. Such size range is reference to the diameter of the particle, i.e., the largest linear dimension through the particle. Furthermore, the particulate may be characterized by a mean particle diameter. Accordingly, with respect to a mean particle diameter, the particles may have a mean diameter by volume of between about 1-15 μm, including all values and ranges therein.

In the case of triboelectric particulate, one may utilize poly(methyl methacrylate) (PMMA) particulate having a size of between about 10-20 μm which may be combined with a polyurethane liquid coating at about a 15-25% loading (wt) and applied to the surface of the roller to provide a coating thickness of about 140 μm. The PMMA particles can be purchased from Soken Chemical and Engineering Co. Ltd. (for instance MX1500-H), or similar grades from other manufacturers.

This may then be followed by a finishing operation, in which the surface of the roller may be ground to remove a portion thereof which may then expose all or a portion of the particulate material and/or voids that may be inherently present in the roller material itself (e.g. when the material is a foam) as noted above. Accordingly, one need only remove that portion of the roller surface that is sufficient to expose the internal voids, e.g. 4 μm or more of the roller surface. Furthermore, in the event that one elects to utilize a coating containing particulate, one may remove 4-80 μm of the roller surface, including all values and increments therein. Accordingly, in this situation, when finishing, voids may be uncovered or formed by the release of a portion of the particulate material from the surrounding resin matrix. Such grinding (physical removal of material) may include centerless grinding, wherein the outer diameter of the roller may be adjusted (ground or reduced) to a desired dimension utilizing a grinding wheel, workblade and regulating wheel, wherein the roller is not mechanically constrained. Other grinding operations such as traverse or plunge grinding or sanding operations may be employed as the finishing operation. Sanding operations may be understood as either wet or dry sanding wherein roller material may be removed by the use of sandpaper that may be as wide as the roller which roller may then be loaded against the paper for material removal.

It may therefore be appreciated that for a given roller already containing voids in the roller material (e.g. a foam material) the grinding may proceed to uncover such voids so that a desired amount of voids are present on the roller surface. In this situation, the amount of roller surface to be removed may vary as necessary to achieve a targeted level of voids on the surface. In addition, as also noted, the roller may specifically contain a coating including particulate, wherein the coating itself may be ground and particulate released to provide void formation. One may therefore remove 5-50% of such coating thickness in order to trigger particle removal and void formation. In addition, the roller herein may specifically have a final thickness (surface of shaft 22 to outer roller surface) of equal to or greater than about 3.5 mm. In addition, the thickness may be in the range of about 3.5 mm to 10.0 mm, including all values and ranges therein.

By adjustment of the above referenced coating operation, and ensuing grinding operation, the coating containing particulate material may be configured herein to provide that the amount of particulate removed due to grinding is sufficient for development of a desired amount of voids and surface roughness (Ra) between voids, which as noted above, may ultimately operate to control the value of toner M/A when positioned in an image forming device and configured to convey toner. In such manner it may be appreciated that for a given component, such as a roller, it may have a surface area, whereupon removal of particulate, voids may form on the roller surface. Accordingly, the roller may also include a plurality of voids having an overall surface area designated as $SA_V$.

In addition, the $SA_V$ divided by the value $(SA_V+SA_R)$ will provide the relative percent of surface area of voids. The relative percent of void surface area may therefore be 1-50% including all values and increments therein. That is, $SA_V/(SA_V+SA_R)$ may have a value of 0.01-0.50 including all values and increments herein, wherein $SA_R$ is the remaining surface area of the roller (i.e. the surface without voids). For example, 0.02-0.40 or 0.2-0.20 or 0.01-0.30 which would correspond to a relative percent of void surface area of 2-40% or 2-20% or 1-30%. In addition, as noted, it is contemplated that the above may apply to image forming device components other than rollers, in which case the remaining surface area of the roller $SA_R$ may be replaced with the remaining surface area of the particular component designated as $SA_C$.

Figure 3A:
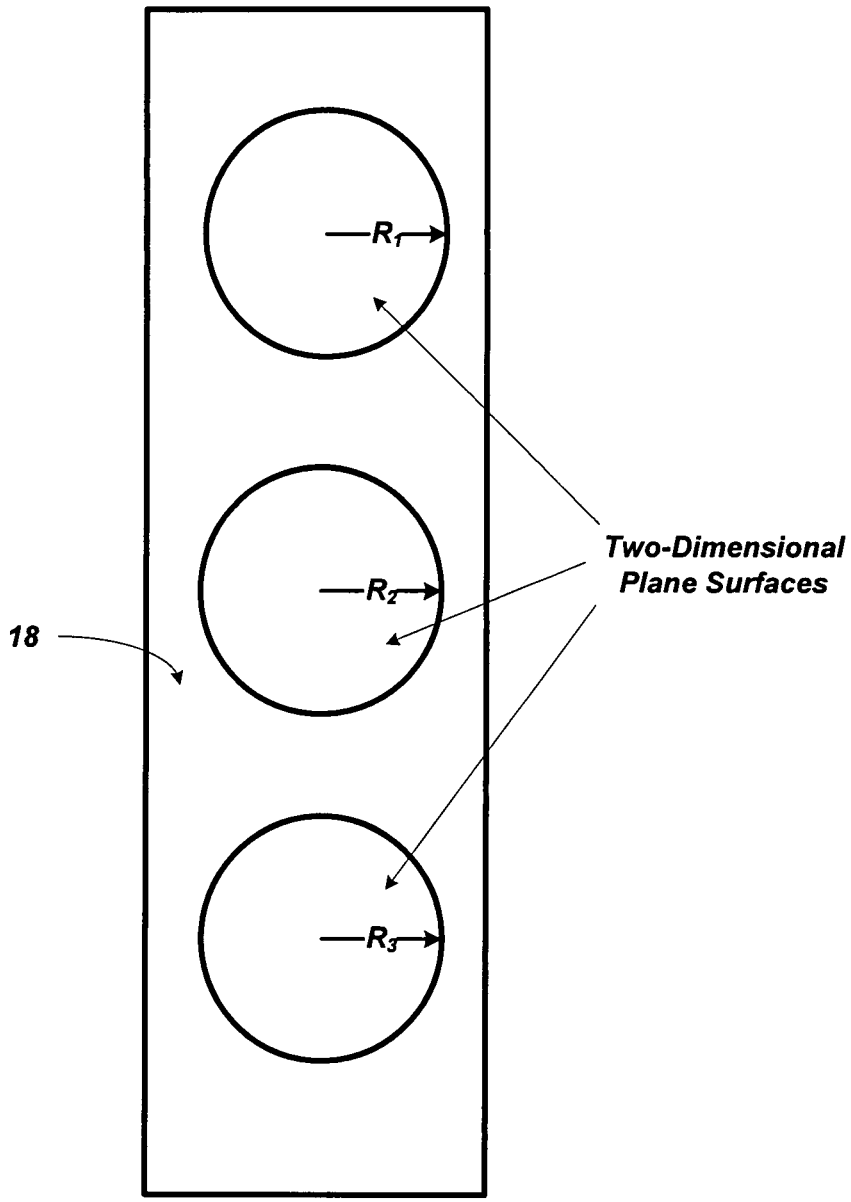
FIG. 3A is a top view looking down on a portion of a roller containing voids.

It should be noted that the surface area of the voids may be measured by considering a 2 dimensional plane surface defined by the 3 dimensional void that is formed in the roller surface and computing its relative area. For example, as shown in FIG. 3A, which represent a view looking down on a portion of the roller 18 contain three exemplary voids, the surface area of such voids or $SA_V$ may be determined by measuring the area of the circles so indicated, i.e. $SA_V=\pi R_1^2+\pi R_2^2+\pi R_3^2$ where $R_1$, $R_2$ and $R_3$ are the respective radius values of the circles shown in FIG. 3A. More basically, it may be appreciated that in the case of n circular voids, the surface area of the voids may be expressed as:

$$SA_V = \sum_{i=1}^{n} \pi R_n^2$$

In addition, it should be clear that other void surface areas defining a 2 dimensional plane surface other than a circle may therefore be calculated utilizing the appropriate mathematical expressions. For example, the voids may assume an elliptical shape or be even a relative cubic shape, etc.

Accordingly, in that situation wherein a given polyurethane coating liquid contains about 20% by weight loading of a selected particulate, the grinding operation may lead to a loss of about 10% or more of the particulate material, including all values and increment therein. Exposed coating surface area may be formed that contains about 10% voids and 10% particulate material, wherein the latter has not been removed. More generally, the present disclosure contemplates that about 10%-100% by weight of the particulate material may be removed from the surface, including all values and increments therein. For example, about 30%-70% may be removed, or about 40%-60%, to provide voids in the surface.

It may therefore now be appreciated that by coating and grinding, a surface may be provided that may have a desired amount of voids as well as a desired surface roughness between the voids. Accordingly, a surface roughness of between 0.1 to 5.0 microns Ra may be provided (via a contact profilometer, see below) including all values and increments therebetween. For example, the surface roughness between voids may have Ra values of between about 0.1-1.5 μm, or 0.1 to 1.0 μm, or 0.3 to 0.8 μm. Such values for Ra can measured using a contact profilometer incorporating a stylus such as a TKL-100 from HommelWerke. This stylus has a radius of 5 microns and maintains contact with the surface to be characterized at a force of 0.8 mN. The stylus is dragged across the surface with a trace length of 4.8 mm using a cutoff length of 0.8 mm. The surface profile is plotted and a mean line is generated. The Ra is the average deviation of the true surface from the theoretical mean surface across the assessment length.

One may also measure the surface roughness between voids by a light detector, which may then provide $Ra_L$ measurements in the range of 1-25 μin, including all values and increments therein. For example, 5-20 μin or 10-20 μin, etc. Such values for $Ra_L$ can be measured by light detector measurements and may be performed using a sensor that may include a light source and a detector. Light may be emitted from the light source, reflected from the surface and detected by the detector. The more diffuse the light, the rougher the surface.

Figure 3B:
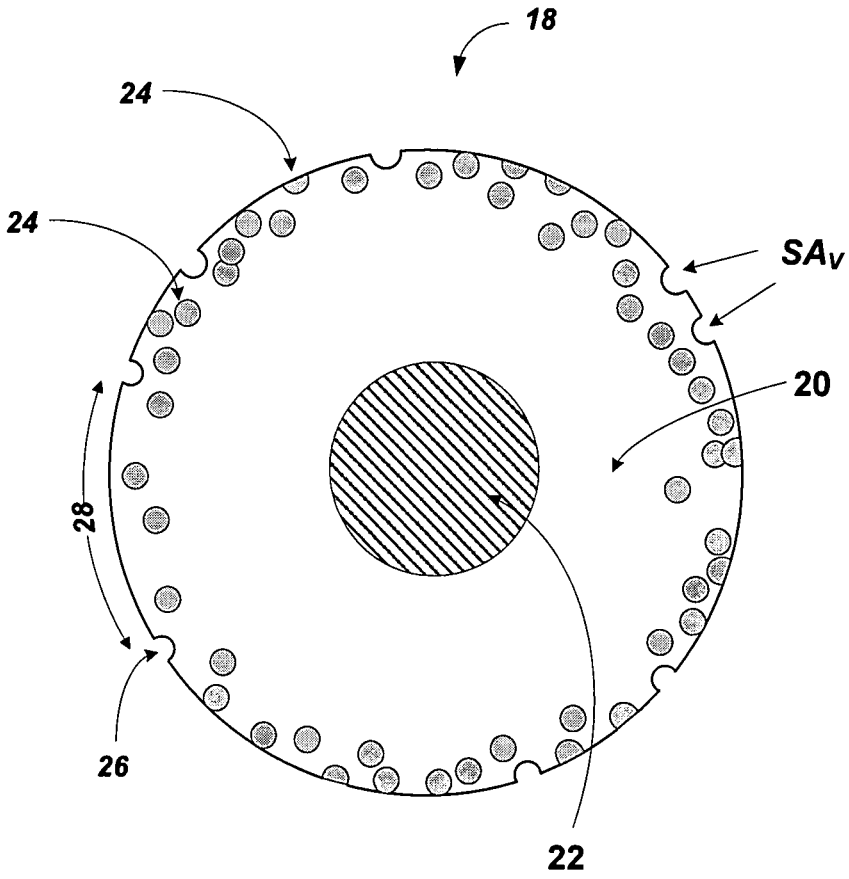
FIG. 3B is a cross-sectional view along line 3-3 of FIG. 2.

Attention is next directed to FIG. 3B, which provides a cross-sectional view of an exemplary developer roller 18 including particulate material 24. As can be seen is this exemplary cross-sectional view, the particulate material 24 may be exposed on a portion of the exposed roller surface area. In addition, voids 26 may be formed, which collection of voids will, as noted above, provide a void surface area ($SA_V$) for the roller where such voids may be the result of the particulate material 24 being removed from the surface during the grinding process. In addition, as also alluded to above, upon finishing, regions 28 may be developed between the voids that may have the above indicated Ra values. It may be appreciated that the region 28 between voids illustrated in FIG. 3B is for illustration purposes and the distance between voids may of course completely vary as contemplated herein. It should also be noted that the value of Ra between voids and/or the $SA_V$ contemplated herein may be accomplished by the above referenced grinding procedure or it may also be an inherent characteristic of the roller as formed. Furthermore, as noted above, the particulate material herein may also be selected such that it is capable of being dispersed in a given liquid coating (organic or aqueous) as well as being chemically reacted and bonded to either the coating resins and/or roller core material 20. For example, one may specifically consider the use of a hydroxyl-terminated acrylic polymer as a triboelectric charging particulate material, in conjunction with a diisocyanate and an appropriate hydroxy-terminated polyol for a coating composition. The polyurethane as formed from such ingredients may therefore include the acrylic triboelectric charging material bonded directly to the polyurethane. This may then control (reduce) the loss of triboelectric particulate material and void formation when the roller is mechanically ground while also achieving a desired surface roughness between voids. The fraction of particles removed from the roller surface may therefore be dependent upon grinding conditions and the adhesion or bonding properties of the particulate in the coating material.

Figure 4:
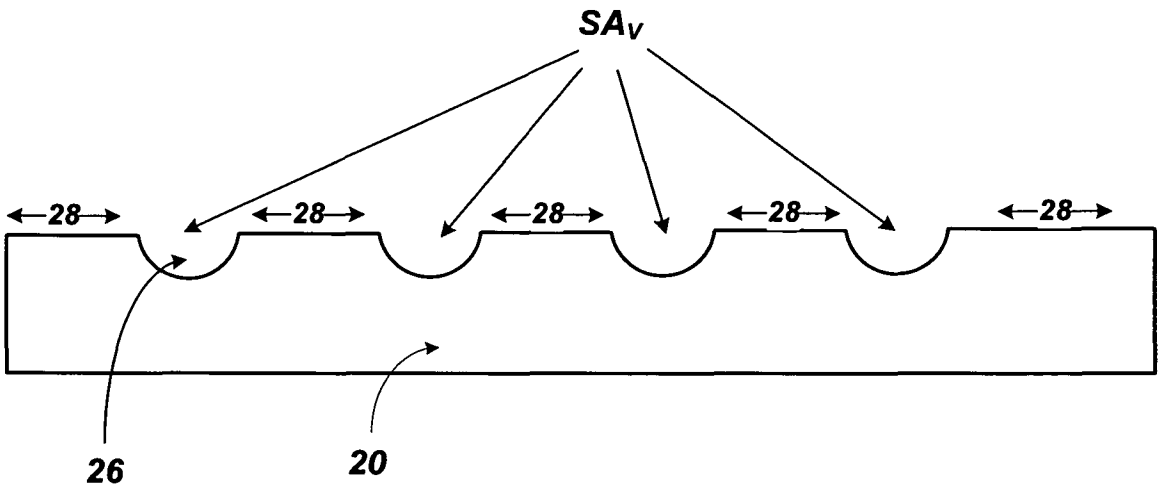
FIG. 4 is a cross-sectional view along the length of a portion of the roller surface of FIG. 2.

FIG. 4 illustrates a more detailed cross-sectional view of a portion of the roller surface along the roller length. As can be seen, the roller surface may include one or more voids 26, each of which will contribute to providing an overall surface area of voids ($SA_V$). As noted above, the value of $SA_V$ may be determined by a consideration of the 2 dimensional plane surface area defined by a void. See again, FIG. 3A and the accompanying discussion. Accordingly, the combination of the voids 26 with their associated surface area, and Ra values between the voids shown generally at 28, may be controlled herein to influence the mass of toner conveyed in a given printer and for a given toner.

Several experiments were performed using developer rolls with various combinations of relative % voids (i.e. $SA_V$ divided by the value ($SA_V+SA_R$)) along with roughness values (Ra) between voids, while holding all other variables constant. The data was analyzed using a 2 order polynomial fit regression model of the form $$M/A=b_0+b_1*V+b_{11}*V^2+b_2*SR+b_{22}*SR^2+b_{12}*V*SR$$

where M/A=predicted M/A on the developer roll, V=% of surface area comprised of voids, or $SA_V$ divided by the value ($SA_V+SA_R$) as described earlier, SR=surface roughness between voids and $b_0$, $b_1$, $b_{11}$, $b_2$, $b_{22}$, $b_{12}$ are regression coefficients resulting from the regression analysis. Best-fit regression coefficients were then determined for the following three cases:

Using only Surface Roughness (SR) as an input (i.e. forcing $b_1=b_{11}=b_{12}=0$)

Using only % Voids (V) as an input (i.e. forcing $b_2=b_{22}=b_{12}=0$)

Using both SR and V as inputs (i.e., solving for all 6 regression coefficients simultaneously)

Predictions from the resulting models were compared to measured values and Pearson Correlation Coefficients (normally referred to as $R^2$, or R-squared, values) were computed for each case. $R^2$ is interpreted as the fraction of the total variation in the data that is explained by the model. As such, higher $R^2$ values are desirable (e.g. if $R^2$=1.0, the model is a "perfect fit", and explains all variation observed in the output; if $R^2$=0.50, the model explains only half of the data variation, etc.). $R^2$ values for the 3 models are shown in the table below:

| M/A Predictive Model Includes | $R^2$ |
|---|---|
| Roughness Only (SR) | 0.53 |
| Void Percent Only (V) | 0.70 |
| Both SR and V | 0.80 |

The table above therefore demonstrates that both roughness between voids (Ra) and void surface area influence and control the toner mass per unit area or M/A with respect to a given image forming component having such characteristics and configured to convey toner. Accordingly, once the regression coefficients have been determined, the full predictive model (including effects of SR and V) may then be used to generate contour maps showing relatively constant lines of M/A in order to identify an operating space. Accordingly, a contour map herein may be understood as plot of surface roughness (Ra) values between voids against the percent of surface area containing voids ($SA_V$ divided by the value ($SA_V$+$SA_R$)) with the calculation of relatively constant M/A lines and the identification of an operating space defined by the area between selected M/A lines. Such operating space may then be employed to monitor and control subsequent roller manufacturing to ensure that a given roller will convey toner within an image forming apparatus or printer cartridge to targeted M/A values. As illustrated, straight line connections may be utilized between the selected endpoints of the calculated (predicted) M/A values.

For example, one may assume that a required M/A operating window (based on print quality requirements) ranges from 0.45 and 0.65 mg/cm$^2$ for a given toner type. In addition, it may then be determined that such operating window is to be maintained across any and all operating environments. An operating space for each environment may now be generated, with the overlapping acceptable regions becoming the operating space for the developer roll surface parameters SR and V. Such an example of an operating space is shown in FIG. 5 which plots the Ra value via a light detection technique as noted above versus the percent of surface area containing voids.

Figure 5:
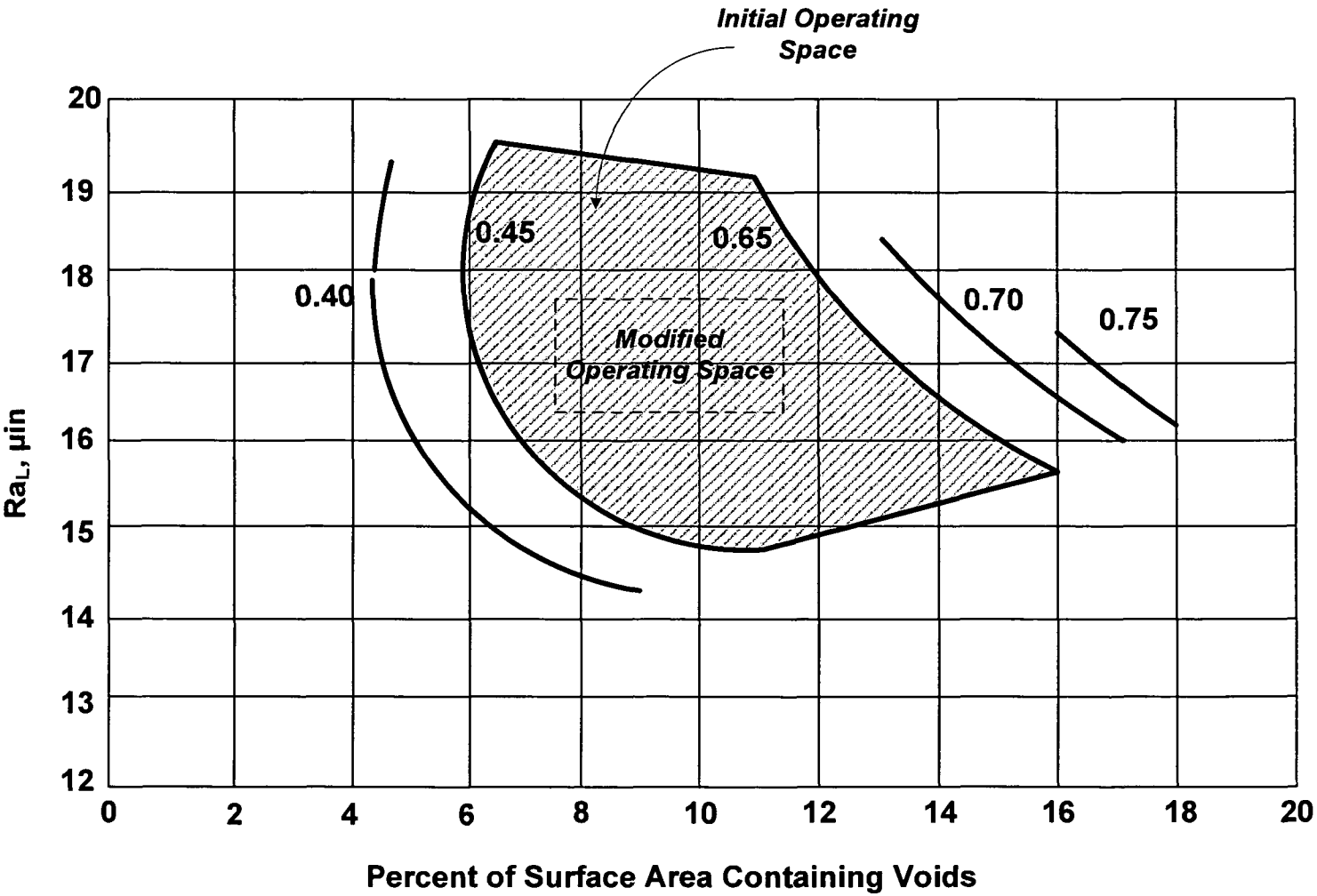
FIG. 5 is an example of a contour map demonstrating a plot of surface roughness between voids versus the percent of surface area containing voids along with a calculation of relatively constant M/A lines (mass per unit area) via a polynomial regression fit for an exemplary image forming device component.

More specifically, as illustrated in FIG. 5, the lower M/A curves (0.40 and 0.45 mg/cm$^2$) were generated by analyzing the data with the above referenced polynomial fit regression for a roller in a relatively hot/wet environment (78° F. @ 80% R.H.) and the relatively higher M/A curves (0.65, 0.70, 0.75 mg/cm$^2$) were generated for a relatively cooler/drier environment (60° F. @ 80% R.H.). The indicated area between the lower counter line at 0.45 mg/cm$^2$ and the upper counter line at 0.65 mg/cm$^2$ may then define an initial operating space or allowable range of surface roughness values (Ra) and percent surface area of voids. In addition, it may be appreciated that one may select what may be termed a modified operating space, illustrated as a dashed box in FIG. 5, which may be understood as an area that is relatively smaller than the initial operating space indicated in FIG. 5 to further maintain M/A values within an identified target range.

FIG. 5 was created using a developer roller with a checkmark doctor blade with a 0.68 mm radius, located at approximately 11N of total force. The developer rolls tested were about 20.1 mm in diameter rotating at approximately 240 rpm. The developer roll coating contained various concentrations of about 15 μm diameter PMMA particulate. Particulate concentration and grinding parameters were then employed to adjust the surface roughness between voids (Ra values) and void characteristics of the test rolls. CPT toner (i.e. toner prepared via chemical processing techniques as opposed to pulverization techniques) of about 6.5 μm was used for this testing.

In such regard, toner herein may be understood as any particulate material that may be employed in an electrophotographic (laser) type printer. Toner may therefore include resin, pigments, and various additives, such as wax and charge control agents. The toner may be formulated by conventional practices (e.g. melt processing and grinding or milling) or by chemical processes (i.e. suspension polymerization, emulsion polymerization or aggregation processes.) In addition, the toner may have an average particle size in the range of about 1 to 25 microns (μm), including all values and increments therein. The resins that may be employed in such toners may include polymer or copolymer resins sourced from styrene and acrylate type monomers, as well as polyester based resins. The various pigments which may be included include pigments for producing cyan, black, yellow or magenta toner particle colors.

Figure 6:
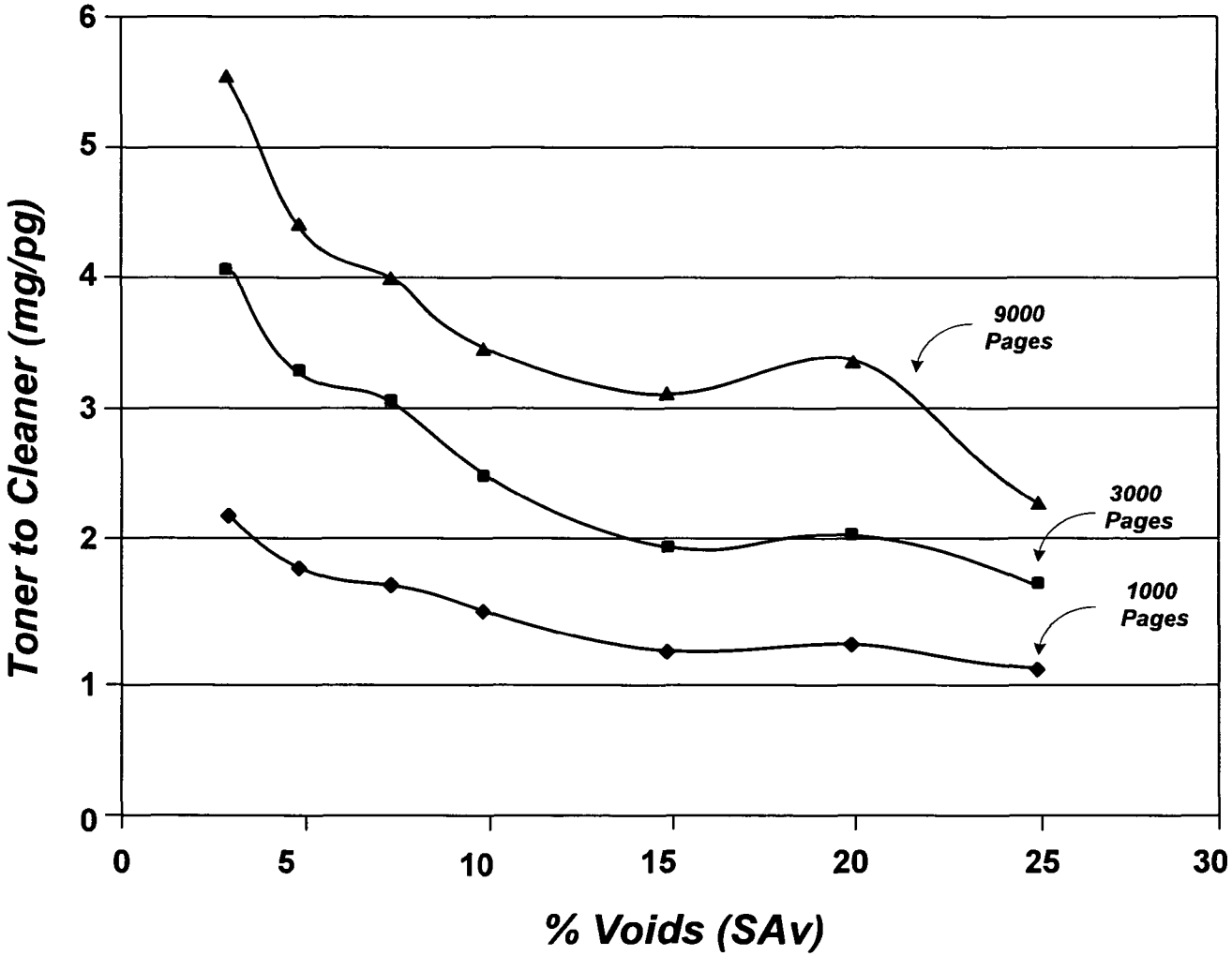
FIG. 6 illustrates the influence of the values of percent surface area of voids versus toner to cleaner (TTC) values (mg/page) for printer life of 1000 pages, 3000 pages and 9000 pages.

It is also worth noting herein that another artifact of the printing process is that the toner that is located on a photoconductive drum (the toner image) may not be completely transferred to the media (e.g. paper). The residual toner on the PC drum may then be cleaned off of the drum (e.g., by a cleaning blade) and deposited in a wasted toner receptacle. It is contemplated that such waste toner may be the result of relatively poor toner charging in the development process, such that the toner may not be removed from the PC drum via the electric field at the transfer-to-media station. The toner so collected may be termed "toner-to-cleaner" which may be evaluated in terms of mg/page. Attention is therefore directed to FIG. 6 which illustrates the influence of the values of percent surface area of voids ($SA_V$) versus toner to cleaner (TTC) values (mg/pg) for a printer life of 1000 pages, 3000 pages and 9000 pages. As can be seen, the value of TTC decreases with an increase in $SA_V$. It is contemplated that the voids in the surface of the developer roll may cause the toner to tumble at the various nips and therefore provide a relatively more complete and uniform charge. The resulting improved toner charge on the PC drum may then transfer more efficiently and may thereby result in relatively less toner waste (i.e. lower TTC).

It should also be noted herein that a combination of parameters exist that may influence a problem known as "filming." Such parameters may include toner properties, developer roll properties, doctor blade properties, speeds, heat environmental factors, etc. Filming may occur when toner sticks to the various surfaces of the developer components, which may be due to the toner being exposed to heat and/or pressure over a long enough time to cause unwanted fusing. Typically, filming on the doctor blade surface may result in white streaks on the printed output due to filmed regions blocking toner from flowing beneath the blade. Developer roll filming may often result in relatively poor toner charging which may result in a variety of print defects. Accordingly, in addition to the above, it was determined that the addition of the voids herein to the surface of an image forming device component (e.g. a developer roller) can assist in the control of such filming. For example, various tests indicated that doctor blade and developer roll filming occurred at about 2000 pages of cartridge life for one cartridge configuration that did not have voids in the developer roll surface. However, developer rolls with a $SA_V$ of greater than about 3.0% showed little or no signs of filming throughout the developer roller life.

A variety of components may be present in an image forming device or image forming device cartridge that may be suitable for incorporation of voids and surface roughness which may now benefit from having a manufacturing protocol that defines an operating window or space (see again FIG. 5) to assist in regulating toner layer thickness or toner mass per unit area (M/A) to a desired range. It is therefore contemplated herein that the values of M/A herein may be regulated by the above described control of void formation and surface roughness between voids, to remain within the range 0.20 $mg/cm^2$ to 1.0 $mg/cm^2$, including all values and increments therein. For example, surface roughness between voids may be within the range 0.30 $mg/cm^2$ to 0.90 $mg/cm^2$, or 0.40 $mg/cm^2$ to 0.80 $mg/cm^2$, etc. Again, such M/A values may be applied to selected toner formulations where the particle size may be 1-25 μm.

It may therefore be appreciated that the above referenced components may include any component that may come in contact with toner and which is capable of conveying toner. This then may include, but not be limited to, a toner addition roller (TAR) or developer roller which may contact with one another, wherein the TAR may be designed to feed or convey toner to the developer roller. A TAR roller may therefore be understood as any component that provides (e.g. transfers) some quantity of toner from a location in the printer or cartridge to a developer roller. The developer roller in turn may then supply toner to a photoconductive (PC) component, such as a PC drum. A developer roller may therefore be understood as any component that provides (feeds or delivers) some amount of toner to a given PC surface.

In addition, the components noted above may also be separately electrically biased to also promote toner transfer via the use of differing potentials, e.g., as between a TAR and developer roller. The toner on the developer roller, as noted, may then be conveyed and applied to the surface of the photoconductor due to a potential difference between the potential areas of the exposed image on the PC drum and the developing potential of the toner on the developer roller.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method comprising:

generating, for one or a plurality of image forming device components wherein said components have a plurality of voids and a surface roughness Ra between voids, a plot of surface roughness Ra between said voids versus the percent of surface area containing voids including a calculation of constant mass/unit area (M/A) lines;

identifying an operating space defined by an area between selected constant M/A lines; and manufacturing an image forming device component with a surface roughness Ra between said voids and a percent surface area that is within said identified operating space.

2. The method of claim 1 wherein said constant M/A lines have a value of between 0.20 $mg/cm^2$ to 1.0 $mg/cm^2$.

3. The method of claim 1 wherein Ra has a value of 0.1 to 5.0 microns.

4. The method of claim 1 wherein the percent surface area containing voids has a value of 1-50%.

5. The method of claim 1 wherein Ra has a value of 0.1 to 1.5 microns and the percent surface area containing voids has a value of 1-30%.

6. The method of claim 1 wherein said component is a roller and said M/A lines are calculated according to the polynomial fit regression model:

$$M/A=b_0+b_1*V+b_{11}*V^2+b_2*SR+b_{22}*SR^2+b_{12}*V*SR$$

where M/A=calculated M/A for the roller, V=% of surface area of the roller comprised of voids, SR=surface roughness between voids, and $b_0$, $b_1$, $b_{11}$, $b_2$, $b_{22}$, $b_{12}$ are regression coefficients.

7. The method of claim 1 wherein said image forming device component comprises a developer roller capable of conveying toner to a photoconductive surface.

8. The method of claim 1 including positioning said manufactured image forming device component in one of a printer cartridge and a printer.

* * * * *